US009625228B2

(12) United States Patent
Hayden

(10) Patent No.: US 9,625,228 B2
(45) Date of Patent: Apr. 18, 2017

(54) MULTI-BARREL FIREARM APPARATUS WORN ON THE USER'S FOREARM

(71) Applicant: Paul Jacob Hayden, Owensboro, KY (US)

(72) Inventor: Paul Jacob Hayden, Owensboro, KY (US)

( * ) Notice: Subject to any disclaimer, the term of this patent is extended or adjusted under 35 U.S.C. 154(b) by 239 days.

(21) Appl. No.: 14/966,508

(22) Filed: Dec. 11, 2015

(65) Prior Publication Data

US 2016/0313080 A1 Oct. 27, 2016

Related U.S. Application Data

(60) Provisional application No. 62/116,039, filed on Feb. 13, 2015.

(51) Int. Cl.
*F41A 19/68* (2006.01)
*F41C 33/00* (2006.01)

(52) U.S. Cl.
CPC ..... *F41A 19/68* (2013.01); *F41C 33/001* (2013.01)

(58) Field of Classification Search
CPC ..... F41A 19/68–19/70; F41A 19/58–19/62; F41C 9/02; F41C 33/001; F41C 33/00; F41C 33/08
USPC ..... 42/77, 85, 106, 1.11; 89/38
See application file for complete search history.

(56) References Cited

U.S. PATENT DOCUMENTS 1,726,228 A * 8/1929 Juhasz ..... F41C 9/00 42/1.11
2,977,703 A * 4/1961 Sarvis ..... F41A 19/07 42/1.11
3,018,578 A * 1/1962 Hill ..... F41C 9/02 42/1.11
4,398,365 A * 8/1983 Pokhis ..... F41C 9/00 42/1.11
5,673,436 A * 10/1997 Piper ..... F41H 9/10 2/160
5,852,253 A * 12/1998 Baricos ..... F41C 33/001 102/439
8,091,264 B2 * 1/2012 Goertz ..... F41A 19/10 42/1.11
2011/0265364 A1 * 11/2011 Hayden ..... F41A 19/58 42/1.11

* cited by examiner

*Primary Examiner* — John D Cooper
(74) *Attorney, Agent, or Firm* — Gary K. Price

(57) ABSTRACT

A multi-barrel firearm apparatus to be worn on the user's forearm generally having a firearm body that includes a first magazine in firing communication with a first firearm, and a second magazine in firing communications with a second firearm. The firearm body defines a spacing between the first firearm and the second firearm such that the first firearm is not in direct physical communication with the second firearm. The apparatus further includes a communications interface between an internal triggering assembly of each of said first and second firearms and the firearm apparatus' external triggering.

16 Claims, 3 Drawing Sheets

MULTI-BARREL FIREARM APPARATUS WORN ON THE USER'S FOREARM

CROSS REFERENCES TO RELATED APPLICATIONS

U.S. Provisional Application for Patent No. 62/116,039, filed Feb. 13, 2015, with title "Multi-Barrel Firearm Apparatus Worn on the User's Forearm" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates to an electronic apparatus that is a firearm apparatus capable of selectively discharging various projectiles, and more particularly to a firearm apparatus adapted to be worn on the user's forearm and to be fired by action of the user's hand.

2. Brief Description of Prior Art

In today's market for projectile apparatuses, there is a continued demand for electronic firearms having advanced capabilities and appearance. There is therefore a need to provide a firearm apparatus which will revolutionize the entire field of projectile apparatuses.

The prior art is well supplied with variations and designs of projectile firearms that can be primarily differentiated by appearance. While each of the prior art firearms may incorporate various designs and/or appearances, none of these provide the features of the current invention.

Thus there is a continuing need for a firearm apparatus that has the advantages of (1) a firearm that the user may keep attached to his person at ail relevant times without undue difficulty, (2) a firearm apparatus that has its triggering mechanism conveniently activated by action of the user's hand and (3) a firearm apparatus having multiple barrels to effect the mode of firing. Further, it is advantageous for such a firearm apparatus to not rotate or shift and to have proper balance on the user's forearm while being worn. The present firearm apparatus meets these objectives.

SUMMARY OF THE INVENTION

A firearm apparatus to be worn on the user's forearm generally having a firearm body that includes a first magazine pack and a second magazine pack for supplying selected projectiles or ammunition to the firearm apparatus. The magazine packs extend perpendicular to a first firearm and second firearm and on opposite sides of the firearm body for supporting the firearm on the wearer's forearm. The first firearm includes a first barrel and second firearm includes a second barrel. The combination of the base surface with the magazine packs define an open sleeve that conforms to the wearer's forearm.

In the preferred embodiment, the firearm body includes a remote controlled system that includes a controller that is configured and operable to communicate with a first receiver device and a second receiver device, with logic to allow a user to select the receiver device that the controller will communicate with. More particularly, the first firearm includes the first receiver device and the second firearm includes the second receiver device, where both the first and second receivers communicate with the controller.

Preferrably, the controller includes wireless communication circuitry configured to communicate with the first and second receivers, and selection logic configured to allow a user to select from the first and second receivers for firing the associated first and second firearms.

DESCRIPTION OF THE PREFERRED EMBODIMENT

The apparatus of the present invention is directed to a firearm apparatus adapted to be worn on the user's forearm and remotely fired by action of the user's hand. The present invention utilizes a balanced configuration in order to avoid the firearm apparatus from shifting or rotating on the user's forearm during application. In the broadest context, the firearm of the present invention consists of components configured and correlated with respect to each other so as to attain the desired objective.

Figure 1:
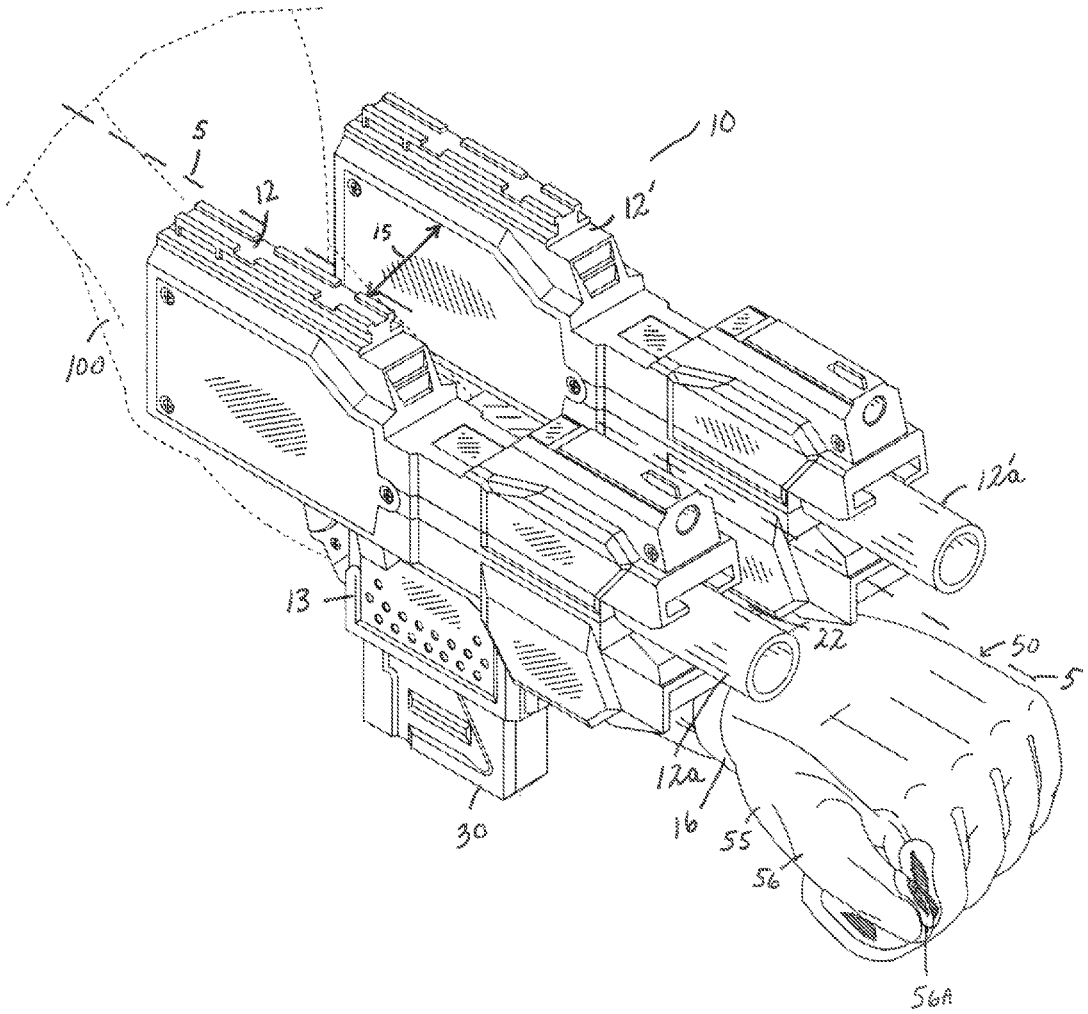
FIG. 1 illustrates a preferred embodiment of the present invention, a firearm apparatus to be worn on the user's forearm.
Figure 2:
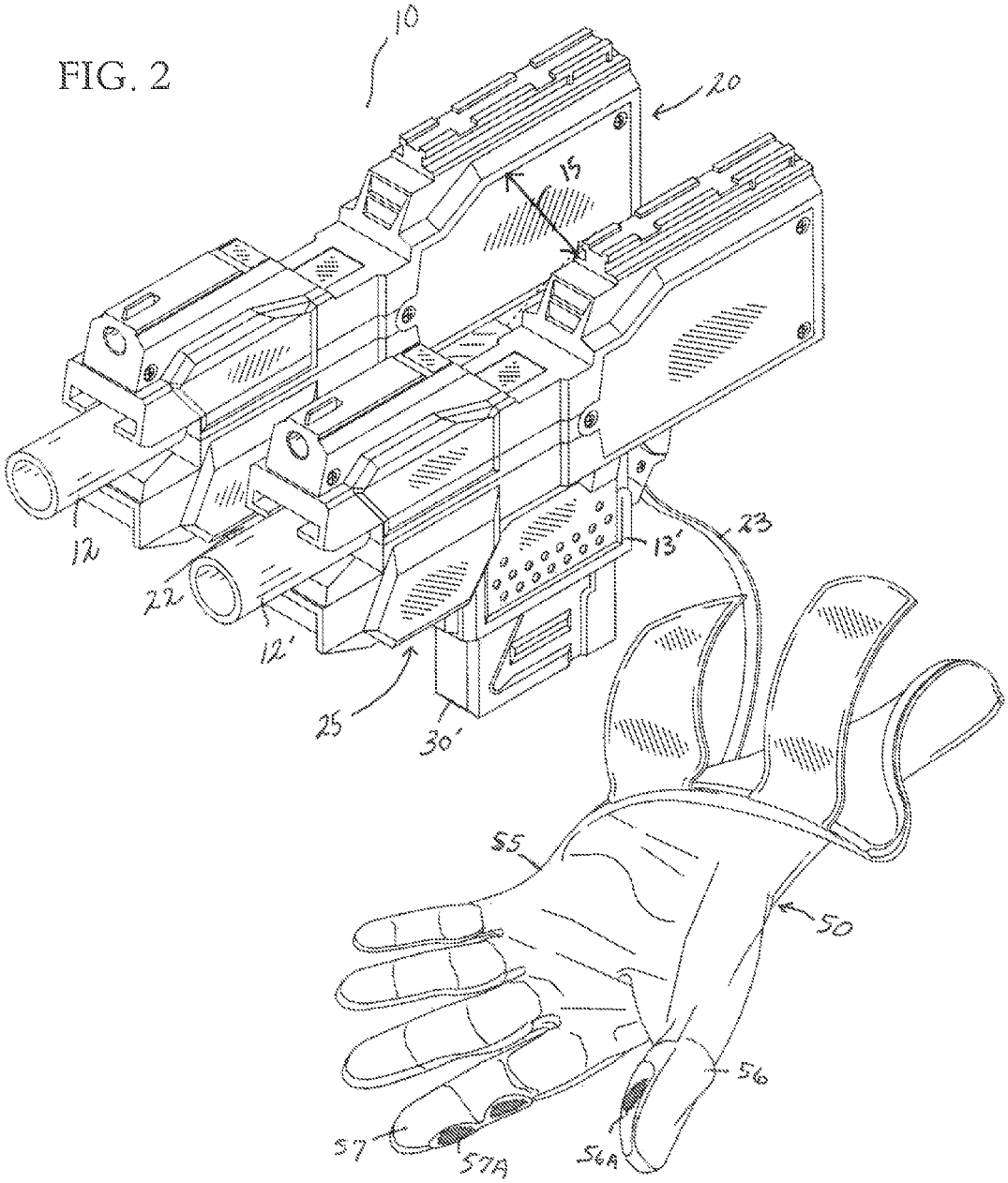
FIG. 2 further illustrates the firearm apparatus of FIG. 1 in application.

Referring to FIGS. 1-2, the firearm apparatus, indicated generally at 10, comprises a first firearm 12, a second firearm 12', a first magazine pack 30 and a second magazine pack 30' for supplying selected projectiles or ammunition to the firearm apparatus 10 and a power source box (not shown) that supplies electricity to the firearm apparatus 10.

The first magazine pack 30 is removably received within a holder 13 of the first firearm 12, and the second magazine pack 30 is removably received within a second holder 13' of the second firearm 12'.

The power source box may consist of a battery pack or other power source that is known in the relevant art. The projectiles or ammunitions might be paintballs, pellets, fluid, bullets or other projectiles for example.

As illustrated, the magazine packs 30, 30 extend perpendicular to a longitudinal axis 5 (see FIG. 1) of the firearm apparatus 10 and are disposed on opposite sides of a base surface 22 for supporting the firearm 10 on the wearer's forearm 100 and can be rotatable to various positions for increased comfort, clearance, efficient transport and balance.

As illustrated, first firearm 12 includes a first barrel 12*a*, and second firearm 12' includes a second barrel 12*a'*.

The firearms 12, 12' are each attached to the base surface 22 such that a spacing 15 (see FIG. 1) is defined between the first firearm 12 and the second firearm 12'.

The magazine packs 30, 30' disposed on opposite sides of the base surface 22 as described effectively balances the weight of the firearm apparatus 10 on the user's forearm 100 during application. It should be understood this balancing feature is unique from the prior art and helps prevent the firearm apparatus 10 from shifting or rotating on the user's forearm 100 during application.

The combination of the base surface 22 with the magazine packs 30, 30' define an open sleeve 25 that conforms to the wearer's forearm 100 and may further include a VELCRO e.g., hook and loop type fastener material strap 16, or other similar attachments or sleeves, straps, bands, for securing to the user's forearm 100 for operation of the firearm apparatus 10.

The firearm apparatus 10 can further include an electrical wire 23 that is electrically connected at one end to each of the first and second firearm's internal triggering assembly (not shown) and connected at the opposite end to the present invention's external triggering means 50. Alternatively, and preferably, rather than electrical wire 23, the firearm's triggering assembly is remotely connected to the external triggering means.

As illustrated in FIG. 2, the firearm's external triggering means 50, in one embodiment, generally includes the end of the electrical wire 23 connected to the external triggering having a first flexible connect and a second flexible connect. In its simplest form, discharging or firing the firearm apparatus 10 is operable by touching the first connect with the second connect in order to complete the electrical circuit.

In one embodiment, the apparatus 10 includes a flexible glove 55 that is worn by the user during application. The glove 55 can include two (2) electrical contact points on opposing portions of the glove 55 for example, the glove 55 includes at least two (2) fingers wherein a first finger 56 has a first contact pad 56A electrically connected to the first connect, and a second finger 57 has a second connect pad 57A that is electrically connected to the second connect. In application, touching the first contact pad 56A with the second contact pad 57A completes the electrical circuit causing the firearm 10 to fire. The contact pads 56A and 57A can be made from a flexible, electrically conductive material.

It should be understood that while the external triggering means 50 of the preferred embodiment may include the glove 55 with first and second contact pads, other activation means such as, but not limited to, a wrist band where cocking the user's wrist causes touching of the first and second connect; or a pad held by the user where squeezing the pad causes the first and second connects to touch, and other similar means can be implemented in place of the glove 55 disclosed. The external trigger means 50 plus the firearm's internal triggering assembly comprise an electrical circuit used for firing the firearm 10.

The remote controlled system includes a controller that is configured and operable to communicate with a first receiver device and a second receiver device. The controller includes logic to allow a user to select the receiver device that the controller will communicate with. More particularly, in the preferred embodiment, the first firearm 12 includes the first receiver and the second firearm 12' includes the second receiver, where both the first and second receivers communicate with the controller. Both receivers have, in one embodiment, differing communication signals and/or protocols for communication with the controller.

Again, controller includes logic to allow a user to select which of the first or second receivers the controller will communicate with. Based on the selected receiver, controller will send associated communication and/or control signals.

Figure 3:
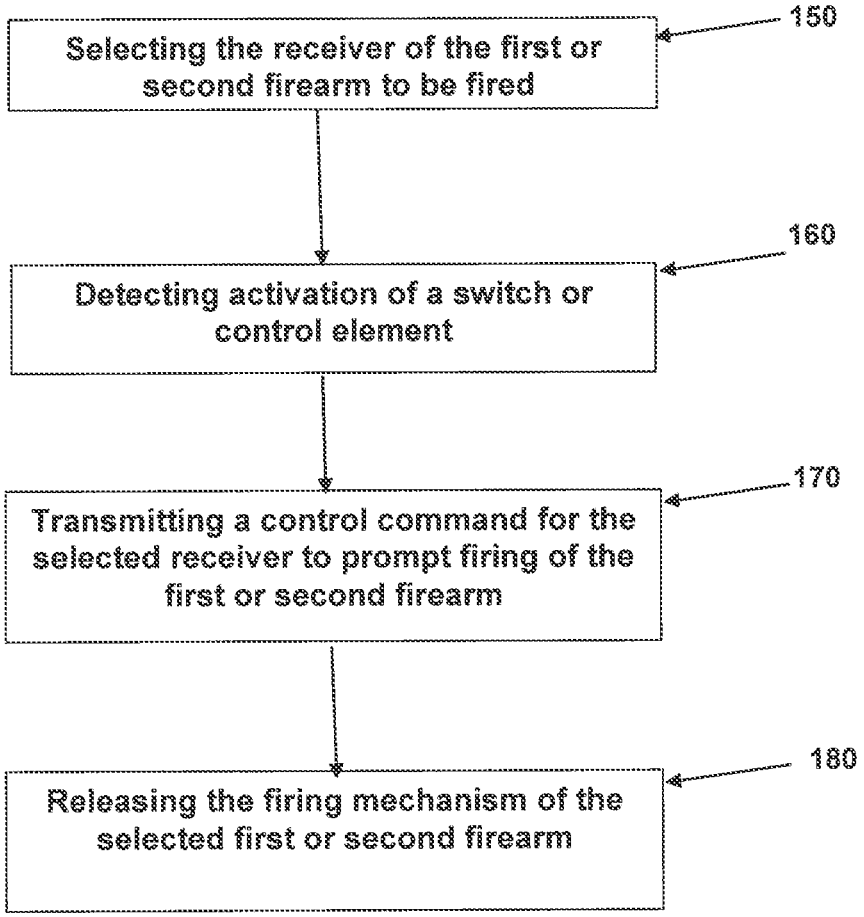
FIG. 3 is a flowchart illustrating a method for selectively firing one of the two firearms according to an embodiment of the invention.

There are many embodiments for controller. Referring to FIG. 3, in one embodiment, the controller includes wireless communication circuitry configured to communicate with the first and second receivers, and selection logic 150 configured to allow a user to select from the first and second receivers for firing the associated first and second firearms. The controller further includes logic for prompting the controller to transmit control commands to the selected first or second firearms. The control commands are transmitted upon selection and detecting activation of a control element (button or switch) 160 and logic for generating and transmitting an associated control command to the selected first or second firearms upon depression by the user of the control element 170. The control command configured to release the firing mechanism 180 of the selected first or second firearm 12, 12'.

It should be understood that the internal triggering assembly for the first and second firearms is known in the art and not claimed in the present invention except for its interface with the present invention's external triggering means 50 as will be discussed, and that the present invention can be fired in a similar manual fashion if so desired without the electrical circuit being completed.

The firearm apparatus 10 as disclosed, defines a first firearm 12 and a second firearm 12" that can be fired, using the remote firing means or the wiring as disclosed, simultaneously or independent of one another.

As shown in the drawings, the firearm is preferably worn such that the barrels 12*a*, 12*a'* of the firearm 10 substantially parallels the user's forearm 100 and the direction of the fingers. When the user's fist is doubled up, the fingers are removed from the line of fire of the apparatus. Thus when the user becomes engaged in "fighting", the user need only double up the fist of the hand to which the firearm is attached, and strike his/her adversary accordingly.

It should be appreciated by those of ordinary skill in the art that firearm apparatus 10 will avow for a quick and efficient means for wearing the firearm and firing the firearm with a simple action of the user's hand, regardless of the type projectile. Use of various projectiles may require modifications to the gun body however, should not result in substantial modifications to the teaching herein of: (1) a firearm that the user may keep attached to his person at all relevant times without undue difficulty, (2) a firearm apparatus that has its triggering mechanism conveniently activated by action of the user's hand.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A firearm apparatus comprising:

a firearm body comprising:

a first magazine pack, and a second magazine pack, and a power source box for supplying electricity to the firearm body, wherein the first magazine pack is removably received within a first holder of a first firearm and the second magazine pack is removably received within a second holder of a second firearm and wherein said first and second magazine packs are disposed on opposite sides of the firearm body, and wherein said first firearm includes a first barrel and said second firearm includes a second barrel, and wherein said first and second firearms are each attached to a base surface of the firearm body such that a spacing is defined between the first firearm and the second firearm, and a communications interface between an internal triggering assembly of each of said first and second firearms and an external triggering, wherein the combination of the base surface and the first and second magazine packs define an open sleeve configured to conform to a user's forearm, and an attachment configured to secure the firearm apparatus to the user's forearm for operation.

2. The firearm as recited in claim 1, wherein said first and second magazine packs extend perpendicular to a longitudinal axis of said firearm apparatus.

3. The firearm apparatus as recited in claim 2, wherein said communications interface includes an electrical wire that is electrically connected at one end to each of the first and second firearm's internal triggering assemblies and connected at the opposite end to said external triggering, and wherein said external triggering having a first connect and a second connect, and wherein touching the first connect with the second connect completes an electrical circuit causing the firearm apparatus to fire.

4. The firearm apparatus as recited in claim 3, further includes a flexible glove that includes a first contact pad that is electrically connected to the first connect and a second connect pad that is electrically connected to the second connect and wherein touching the first contact pad with the second contact pad completes the electrical circuit.

5. The firearm apparatus as recited in claim 4, wherein said first and second contact pads are made from a flexible, electrically conductive material.

6. The firearm apparatus as recited in claim 2, further including a first receiver in operable communications with said first firearm and a second receiver in operable communications with said second firearm, and wherein said communications interface is a remote controlled system that includes a controller configured to communicate with said first and second receivers, and wherein said controller includes logic configured to allow the user to communicate between said first and second receivers.

7. The firearm apparatus as recited in claim 6, wherein said first receiver has differing communication signals than said second receiver for communicating with the controller.

8. The firearm apparatus as recited in claim 7, wherein said logic further configured for prompting the controller to transmit control commands to the first and second firearms.

9. The firearm apparatus as recited in claim 8, wherein the control commands are transmitted upon detecting activation of a control element and generating and transmitting an associated control command to the first and second firearms upon action by the user of the control element.

10. A firearm apparatus comprising:

a base surface, a first firearm attached to the base surface, a second firearm attached to the base surface, wherein a spacing is defined between said first and second firearms, a first magazine received within the first firearm's first holder, a second magazine received within the second firearm's second holder, wherein said first and second magazines extend perpendicularly to a longitudinal axis, wherein said first firearm includes a first internal triggering assembly, and said second firearm includes a second internal triggering assembly, and an external triggering in communications with said first and second internal triggering assemblies, wherein the combination of the base surface and the first and second magazines define an open sleeve configured to conform to a user's forearm, and an attachment configured to secure the firearm apparatus to the user's forearm for operation.

11. The firearm apparatus as recited in claim 10, further including an electrical wire that is electrically connected at one end to each of said first and second internal triggering assemblies, and connected at the opposite end to said external triggering, and wherein said external triggering having a first connect and a second connect, and wherein touching the first connect and the second connect completes an electrical circuit causing the firearm to fire.

12. The firearm apparatus as recited in claim 11, further including a flexible glove that includes a first connect pad that is electrically connected to the first connect and a second connect pad that is electrically connected to the second connect and wherein touching the first connect pad with the second connect pad completes the electrical circuit.

13. The firearm apparatus as recited in claim 10, further including a first receiver in operable communications with said first firearm and a second receiver in operable communications with said second firearm, and a controller configured to communicate with said first and second receivers, and wherein said controller includes logic configured to allow the user to communicate between said first and second receivers.

14. The firearm apparatus as recited in claim 13, wherein said first receiver has differing communication signals than said second receiver for communicating with the controller.

15. The firearm apparatus as recited in claim 14, wherein said logic further configured for prompting the controller to transmit control commands to the first and second firearms.

16. The firearm apparatus as recited in claim 15, wherein the control commands are transmitted upon detecting activation of a control element and generating and transmitting an associated control command to the first and second firearms upon action by the user of the control element.

* * * * *